US006565253B1

(12) United States Patent
Yang

(10) Patent No.: US 6,565,253 B1
(45) Date of Patent: May 20, 2003

(54) WATCH LIGHT

(75) Inventor: Jong H. Yang, Concord, MA (US)

(73) Assignee: The Timberland Company, Stratham, NH (US)

( * ) Notice: Subject to any disclaimer, the term of this patent is extended or adjusted under 35 U.S.C. 154(b) by 0 days.

(21) Appl. No.: 10/039,853

(22) Filed: Dec. 31, 2001

(51) Int. Cl.[7] ..... G04B 39/00; G04B 19/30
(52) U.S. Cl. ..... 368/294; 368/227; 368/295
(58) Field of Search ..... 368/294, 295, 368/299, 83, 67, 227, 241, 306, 308

(56) References Cited

U.S. PATENT DOCUMENTS 3,078,364 A * 2/1963 Neugebauer ..... 362/104
4,910,652 A 3/1990 Rhine
4,972,394 A * 11/1990 DiMarco ..... 368/10
D340,778 S 10/1993 Oberlander
D344,411 S 2/1994 Henry et al.
5,548,565 A * 8/1996 Aoyama et al. ..... 362/103
5,568,971 A 10/1996 Jewell
5,706,255 A * 1/1998 McKay ..... 359/809
6,185,160 B1 * 2/2001 Tsuda ..... 368/223
6,200,019 B1 3/2001 Latini
6,213,619 B1 4/2001 Yu

FOREIGN PATENT DOCUMENTS

JP 53086259 A * 7/1978 ..... 368/83

* cited by examiner

*Primary Examiner*—David Martin
*Assistant Examiner*—Michael L. Lindinger
(74) *Attorney, Agent, or Firm*—Ropes & Gray

(57) ABSTRACT

There is disclosed herein a watch that includes a steerable light. The light may be attached to a rotating bezel on the watch, or included in a crown or other moveable fixture of the watch, such that the light may be pointed independently from the orientation of the watch. A light that is moveably attached to a watch in this manner may be securely fastened to a user's wrist in an unobtrusive form factor, while at the same time freely directed toward an object of interest without requiring a specific orientation of the user's limb.

19 Claims, 5 Drawing Sheets

WATCH LIGHT

BACKGROUND OF THE INVENTION

Flashlights and other similar battery-powered devices have been used for decades to provide a portable source of light to their users. However, flashlights are not usually carried by people in many situations where a light source may be useful, since most flashlights are too big to be carried conveniently, and because flashlights are often misplaced or forgotten by their owners.

One approach to more portable flashlights has been to fashion a light source into a pen or other writing instrument. However, pens are not so habitually carried that they will be reliably available. Further, pens are so small and fungible that they are often misplaced or forgotten. Another approach to portable light sources has been to include a light within a wrist-mounted watch, as described in U.S. Pat. No. 4,910,652 to Rhine. The Rhine system suggests a light source affixed to the face of a watch which provides sufficient light to illuminate the face of the watch for purposes of reading time, and which may also emit sufficient light to provide general illumination. As a significant disadvantage, the light source of the Rhine system is directed statically outward from the face of the watch. Thus a user may be required to engage in significant contortions of limb and body to direct the light in a desired direction, or to remove the watch from the wrist completely.

There remains a need for a portable light source that may be conveniently carried at all times, with a beam whose direction is not rigidly fixed relative to a user's body.

SUMMARY OF THE INVENTION

There is disclosed herein a watch that includes a steerable light. The light may be attached to a rotating bezel on the watch, or included in a crown or other moveable fixture of the watch, such that the light may be pointed independently from the orientation of the watch. A light that is moveably attached to a watch in this manner may be securely fastened to a user's wrist in an unobtrusive form factor, while at the same time freely directed toward an object of interest without requiring a specific orientation of the user's limb.

BRIEF DESCRIPTION OF DRAWINGS

The foregoing and other objects and advantages of the invention will be appreciated more fully from the following further description thereof, with reference to the accompanying drawings, wherein.

DETAILED DESCRIPTION OF THE PREFERRED EMBODIMENT(S)

To provide an overall understanding of the invention, certain illustrative embodiments will now be described, including a watch with an electrically-powered light source. However, it will be understood that the systems and methods described herein may be usefully applied to any wrist-mounted device, such as a scuba diver's depth gauge, and may also be usefully applied to any electronic accessory that may be mounted to a watch bezel, such as an alarm using a piezo-electric buzzer or flashing light-emitting diode. All such applications are intended to fall within the scope of the systems described herein.

Figure 1:
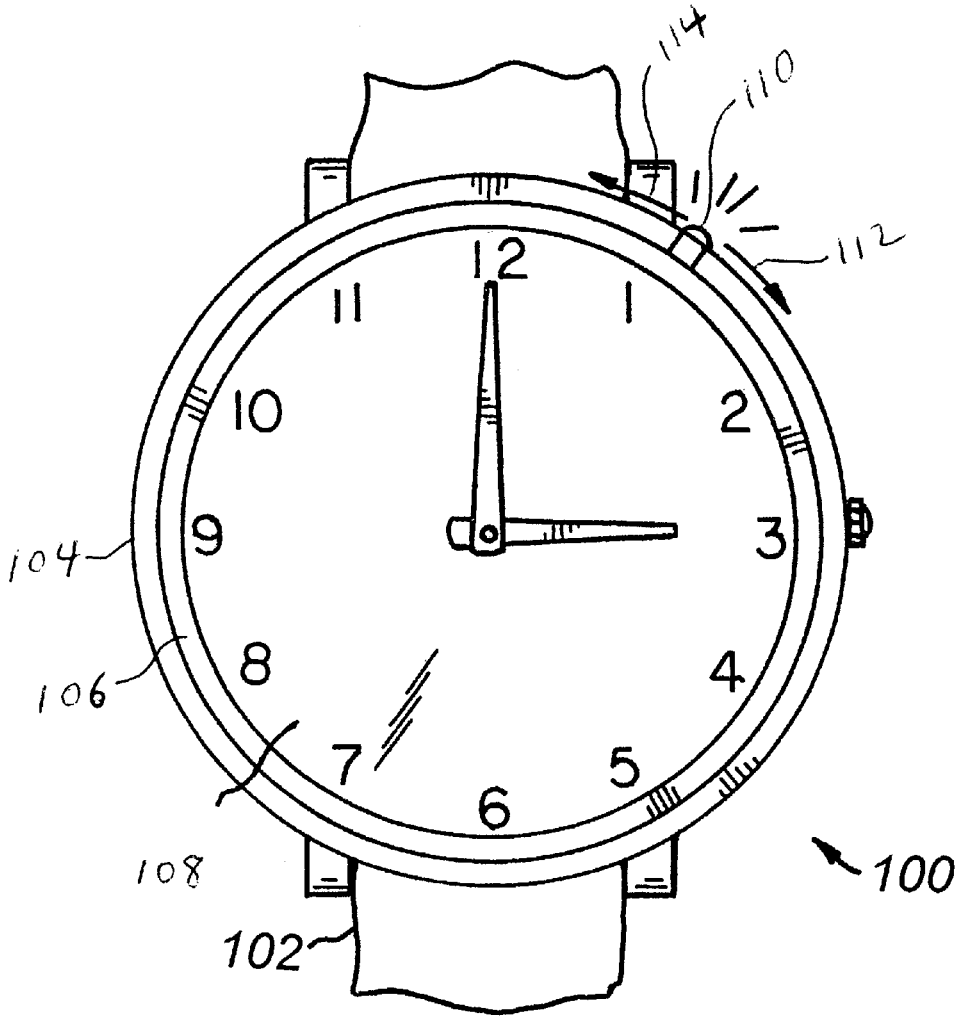
FIG. 1 depicts a watch with a rotating bezel and a light affixed to the bezel.

FIG. 1 depicts a watch with a rotating bezel and a light affixed to the bezel. The watch 100 may include a watchband 102, a case 104, a rotating bezel 106, a face 108, and a light 110.

The watchband 102 may be of conventional manufacture and may include, for example, nylon webbing with VELCRO for fastening the watch 100 about a user's wrist. Other materials such as plastic, rubber, leather, or metal (including links or a flex-band) may also be used, either alone or in combination with other materials.

The case 104 may house electromechanical components of the watch. This may include timing circuitry, a battery or other power supply, springs and mechanical watch movements, motors for movement of the hands of an analog watch, audio alarms, and so forth. The case 104 may be waterproof, and may be fashioned of metal, plastic, or any other suitable material.

The rotating bezel 106 may be a freely rotating circular fixture moveably attached to the casing 104. The rotating bezel 106 may include markings for keeping track of time, recording measurements, or tracking other information displayed upon the face 108 of the watch or otherwise observed by a user.

The face 108 of the watch 100 may be of any form suitable for time keeping functions associated with watches. Although depicted as an analog watch, it will be appreciated that the watch 100 may be a digital watch employing, for example, light-emitting diodes or a liquid crystal display, or the watch 100 may include both digital and analog display elements. The face 108 may also display, in digital or analog form, a day, a date, a stopwatch time, a countdown timer time, and any other information suitable for use with a watch, including, for example, a nautical tide indication or a moon phase clock. The face 108 may also display other information gathered from transducers within the watch 100, such as an altitude, a depth below sea level, a temperature, and so forth. The face 108 may include back-lighting, side-lighting, or front-lighting to illuminate the face 108 for a user, or the face 108 may itself be fashioned of a glowing material. The face 108 may also, or instead, include illuminated numerals and/or hands for reading time in low light conditions.

A light 110 may be affixed to the rotating bezel 106, such that a direction of the light 110 may be controlled by moving the rotating bezel 106 clockwise or counterclockwise about the face 108 of the watch 100, as indicated by arrows 112, 114. A power source, such as a battery, may be provided for the light 110. The power source (not shown) may be placed within the rotating bezel 106, or may be within the case 104, and electrically coupled to the light 110 as shown, for example, in FIG. 2 below. The power source may be the same power source used by other watch electronics, such as the power source in the case 104 mentioned above, or the power source may be a separate battery provided for illumination of the light 110. The power source may generally be any source of electrical power suitable for use with watch electronics and/or the light 110, including conventional batteries employing alkaline, nickel-cadmium, lithium-ion, or any other battery technologies in a suitable form factor.

The light 110 may be activated and deactivated by activating a button (not shown) on the rotating bezel 106, on the case 104, or on the face 108 of the watch. The term button, as used herein, should be understood to be any electromechanical control input, including a button, a push button, a switch, a knob, a slider, a lever, a touch-sensitive sensor, a dial (which may provide variable intensity of the light 110) or any other object or device which can be pressed, rubbed, turned, flipped, or contacted to control operation of the light 110 or other functions of the watch 100.

The term "light" as used herein will be understood to include any light source suitable for general illumination, including an incandescent bulb, a halogen bulb, a light-emitting diode, or chemical luminescence source, unless some other meaning is specifically indicated. One suitable light source is one or more high-intensity (or high-brightness) light emitting diodes, such as those manufactured by Agilent, Cree, or LumiLeds. The light 110 may have a focused or diffuse direction of peak luminous intensity, and may be a white-light source, or have any other spectral profile falling wholly or partially within the visible light range.

Figure 2:
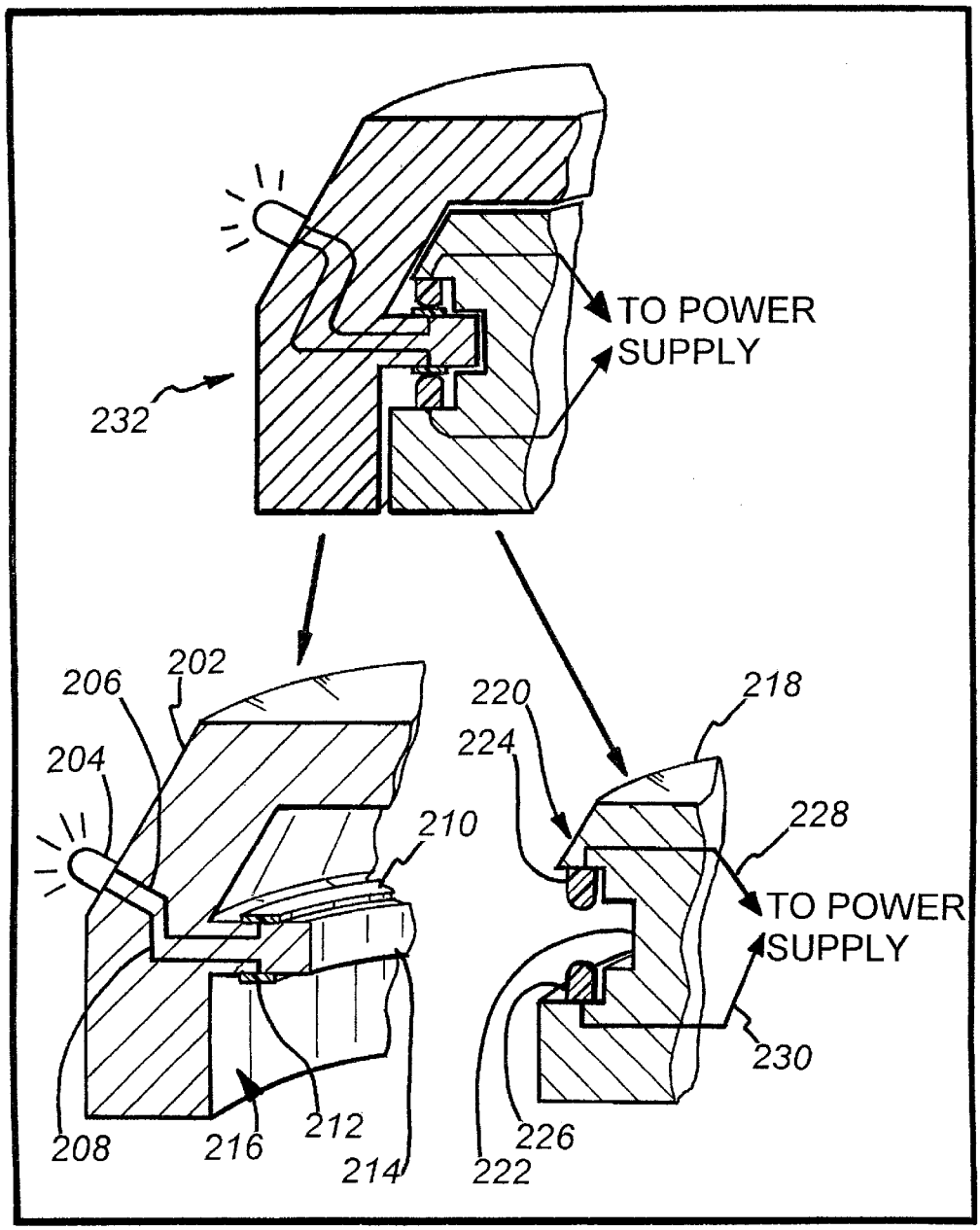
FIG. 2 depicts a structure for electrically coupling a light to a power supply within the case of the watch.

FIG. 2 depicts a structure for electrically coupling a light to a power supply within the case of the watch. A rotating bezel 202 may include a light 204 with two light leads 206, 208 electrically connected to two bezel contacts 210, 212 on a tongue 214 of an inner surface 216 of the bezel 202. A case 218 may have an outer surface 220 with a groove 222 configured to mate with the tongue 214 of the bezel 202, and case contacts 224, 226 electrically connected to two power supply leads 228, 230 which connect to a power source (not shown) within the case 218.

The rotating bezel 202 may be manufactured as, for example, two semicircular halves which are positioned about the case 218 and joined to form a full, circular bezel. The tongue 214 may have a generally rectangular cross-sectional shape, as depicted in FIG. 2, or any other shape suitable for securely and rotatably fastening the bezel 204 to the case 218. The bezel contacts 210, 212 may be formed of an electrically conductive material such as copper plating, with the bezel 202, or the inner surface 216 of the bezel 202, formed of an electrically insulating material. A complementary pair of case contacts 224, 226 may be positioned on the case 218 such that they remain in continuous contact with the bezel contacts 210, 212 of the bezel 202 as the bezel 202 is rotated about the case 218. In this manner, an electrical circuit may be maintained between the light 204 and the power supply as depicted for example in a cross-section 232 of the assembled bezel 202 and case 218. A button, such as any of the buttons described above, may be included in the electrical circuit formed between the light 204 and the power supply. The button may be disposed, for example, on the bezel 202, or on the case 218.

In one embodiment, the bezel contacts 210, 212 are rings of conductive material disposed on the tongue 214, and the case contacts 224, 226 are electrical pads or arms exerting sufficient pressure to maintain physical and electrical contact with the bezel contacts 210, 212. However, other configurations are possible. For example, the case contacts 224, 226 may be rings of conductive material and the bezel contacts 210, 212 may be electrical pads or arms. Similarly, the tongue 214 may be on the case 218, with the complementary groove 222 on the bezel 202. Other configurations may be provided for three or more electrical leads to be coupled between the bezel 202 and the case 218. More generally, other configurations and structures are known for maintaining a continuous electrical coupling between the case 218 and the rotating bezel 202, some of which permit unlimited clockwise or counterclockwise rotation of the bezel 202, and some of which permit a finite number of clockwise or counterclockwise turns. All such couplings may be usefully employed with the watches described herein.

Figure 3:
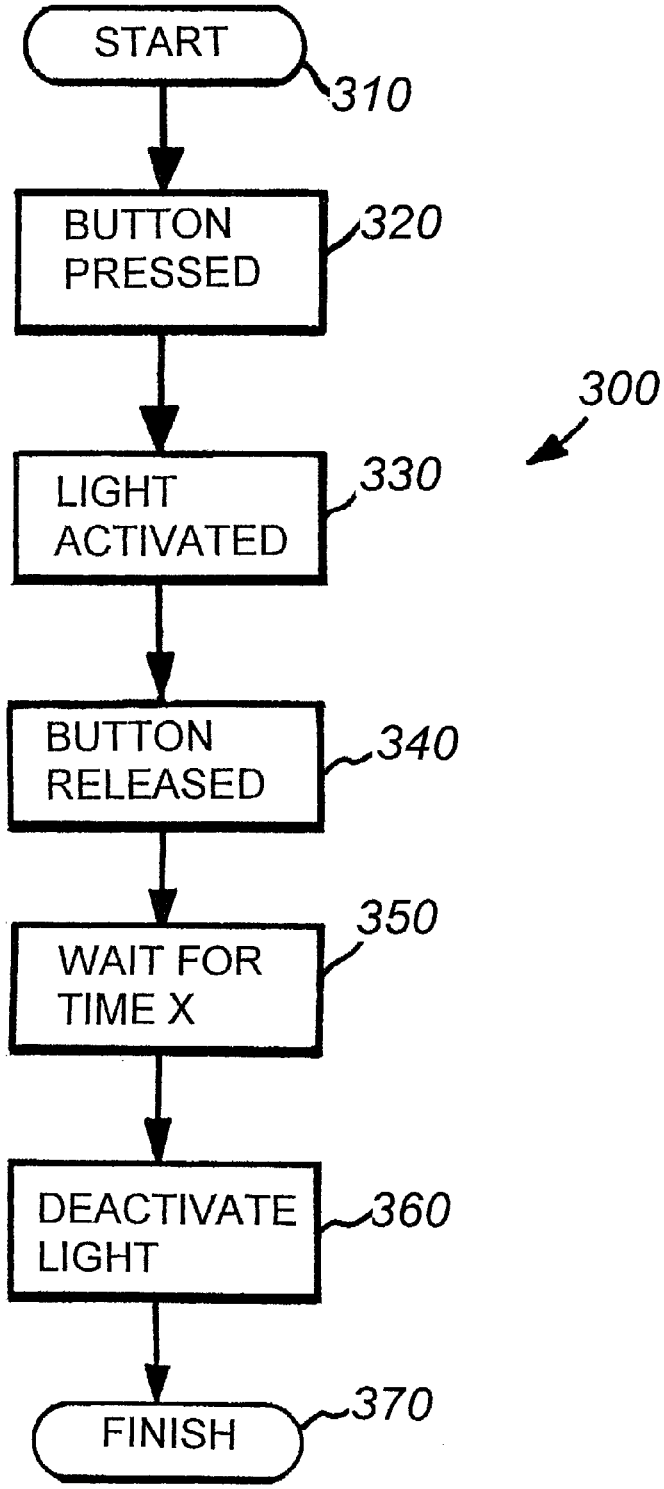
FIG. 3 is a flow-chart depicting a process for de-energizing a light after a fixed time following activation of the light by the user.

FIG. 3 is a flow-chart depicting a process for de-energizing a light after a fixed time following activation of the light by the user. The process 300 starts 310, when a button is pressed, as shown in step 320. The button may be for example, any of the buttons or other activation mechanisms discussed above.

When the button is pressed, a light may be activated as shown in step 330. The light may be any of the lights discussed above, or those discussed below in various other watch light embodiments. As shown in step 340, the button may then be released. When the button is released then the process 300 waits for a time, x, as shown in step 350. The time, x, may be predetermined, and may be, for example, one second, two seconds, five seconds, ten seconds, or any other period of time suitable for use with the watch light. The time, x, may be measured through circuitry such as, for example, a digital timer that is started when the button is released in step 340. This technique may be particularly useful if the watch contains digital electronics for time keeping and other functions. However, even where no digital electronics are employed, a delay circuit may be devised using, for example, a resistor-capacitor network having a time constant suitable for maintaining the light in an 'on' state for the period of time desired. In certain embodiments, a user may control the amount of time, x, for which the light remains activated, such as through the time setting functions provided in a conventional digital watch, or through one or more dials or knobs provided on an analog watch.

Following the period of time, x, in step 350, the light may be deactivated, as shown in step 360. Deactivation may be instantaneous (or nearly instantaneous), or the deactivation may be realized as a dimming effect in which the light passes from its 'on' state to an 'off' state over a period of time such as one or two seconds. The process 300 may then finish 370, and the light may remain off until it is activated again, at which time the process 300 may begin again. It will be appreciated that variations to the above process 300 is an example, and that variations are possible. For example, the period of time, x, during which the light is held in an 'on' state may be determined from the moment that the button is pressed (step 320) rather than the moment that the button is released (step 340). In such an embodiment, the light may deactivate after time, x, regardless of whether the button is released, or the light may remain on past time, x, when the button is not released.

Figure 4:
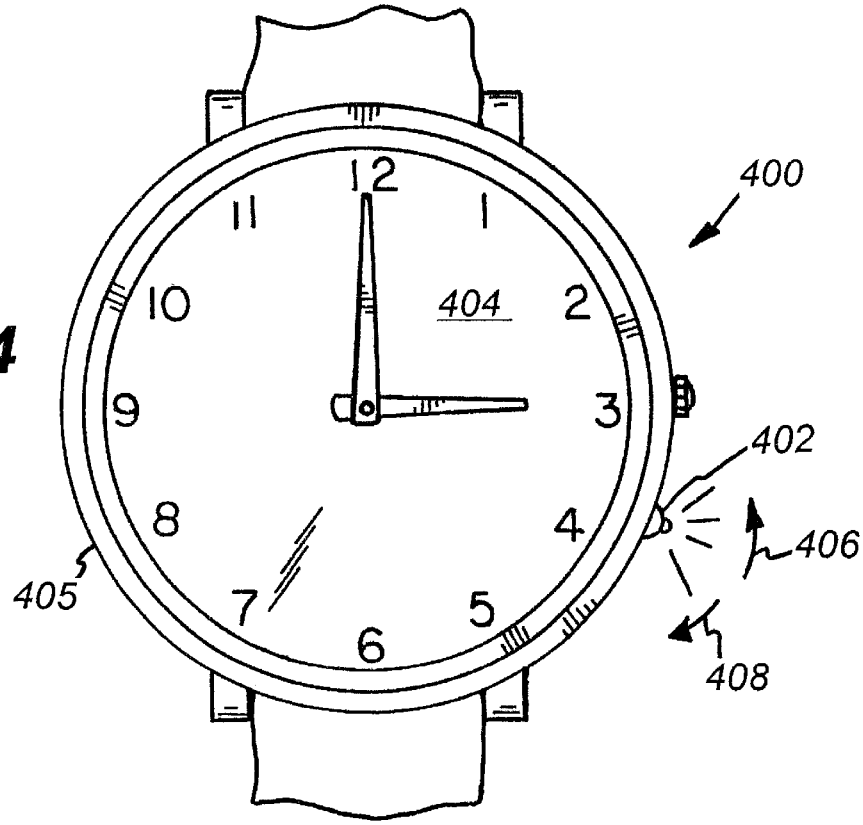
FIG. 4 depicts a watch with a light in a moveable fixture.

FIG. 4 depicts a watch with a light in a moveable fixture. The watch 400, which may be any of the watches described above with reference to FIG. 1, may include a light 402 that may be moved relative to a face 404 of the watch 400, or any other fixed point on the watch 400. The light 402 may be (movably) attached to a case 405 of the watch. The light 402 may, for example, pivot within a plane parallel to the face 404 of the watch 400, as indicated by arrows 406, 408. While such a pivoting light with one degree of freedom for movement may be used, the light may have other degrees of freedom, such as in a plane perpendicular to the face 404 of the watch 400. Two degrees of freedom for directing the light may be obtained using, for example, a light set in a spherical mount.

Figure 5:
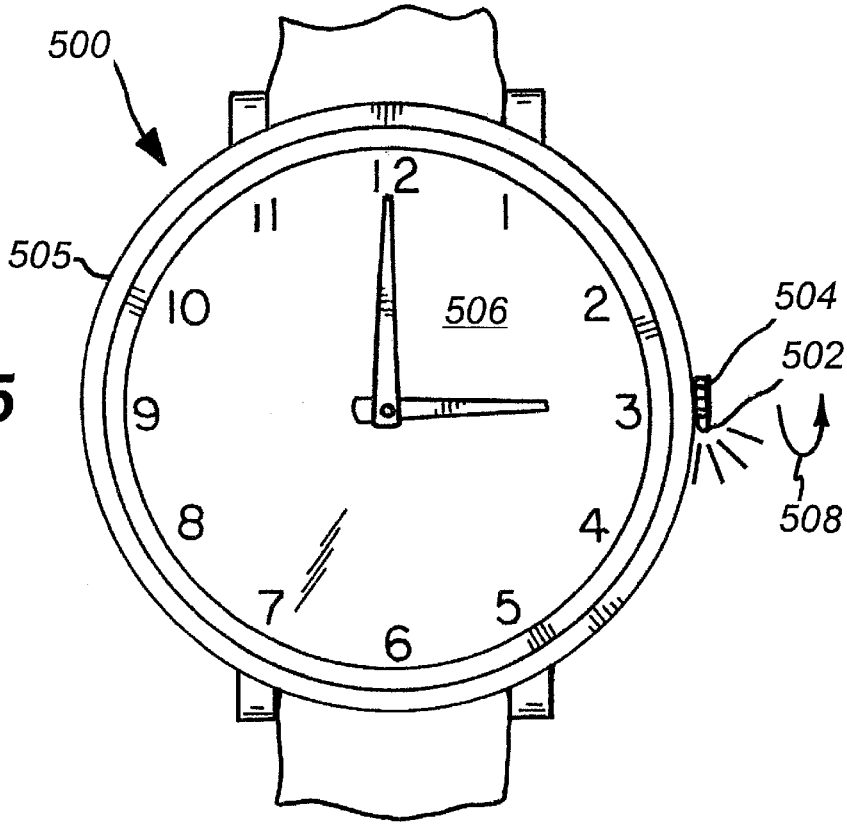
FIG. 5 depicts a watch with a light contained in a crown of the watch.

FIG. 5 depicts a watch with a light contained in a crown of the watch. The watch 500, which may be any of the watches described above with reference to FIG. 1, may include a light 502 in a crown 504 of the watch 500, connected to a power supply (not shown) within a case 505 of the watch. The crown 504 may rotate about an axis extending from an edge of a watch face 506, in a manner such as conventional crowns, and in a manner generally indicated by an arrow 508. As is known in the art, the crown 504 may be used to control a time displayed by the watch 500, as well as a date (not shown) and any other information. In operation, the crown 504 may be extended from the edge of the watch 500 into one or more extended positions. In one of such extended positions, the light 502 may be activated. The light 502 may then be rotated as desired by a user about the axis of the crown 504 to direct the light 502 in a desired direction.

Figure 6:
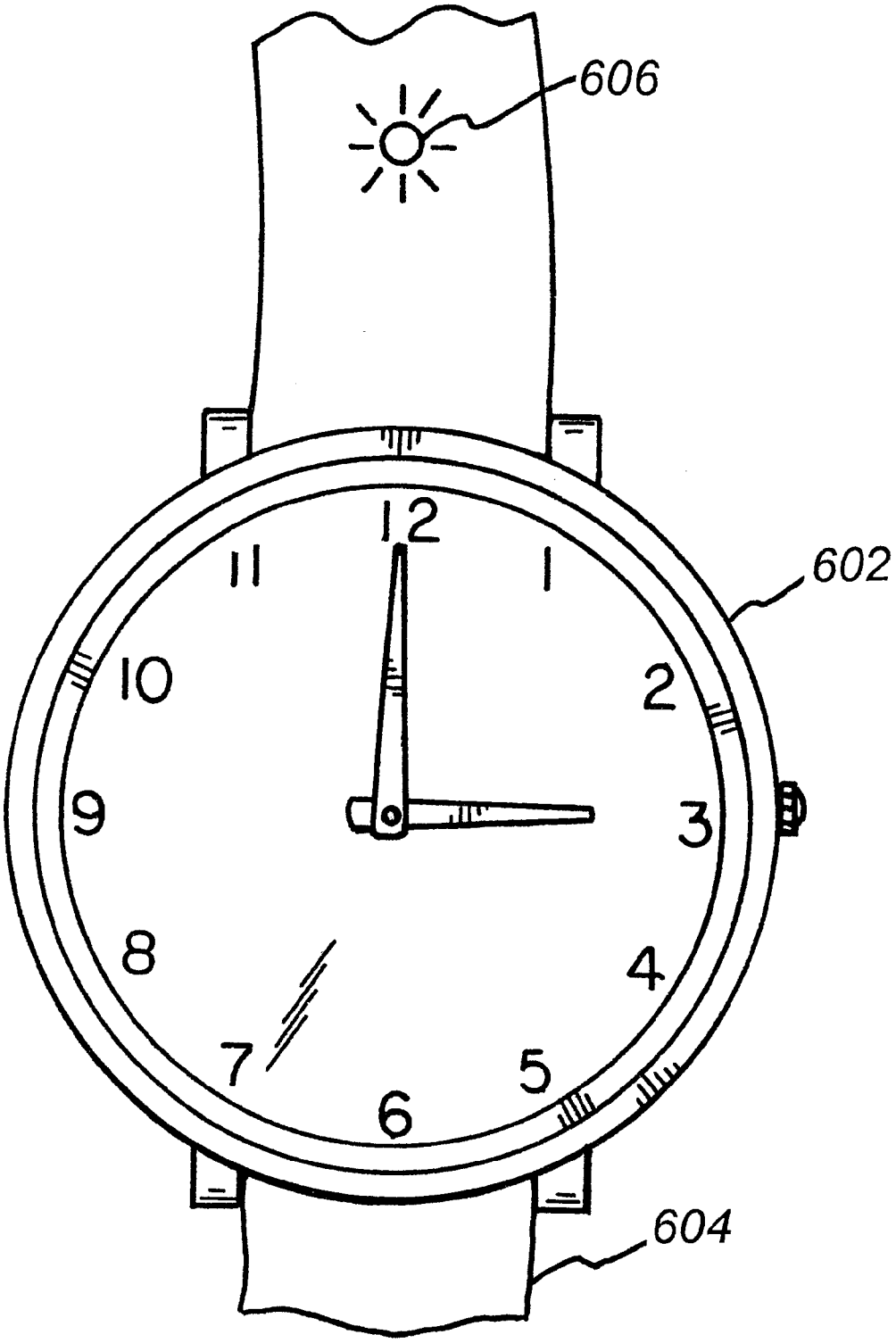
FIG. 6 depicts a watch with a light contained in a watch strap.

It will be appreciated that a light may be usefully located in a variety of other positions in a watch. For example, FIG. 6 depicts a watch with a light contained in a watch strap. The watch 602, the watch strap 604, and the light 606 may be any of the watches, watch straps, and watch lights discussed above. The light 606 may be affixed to the watch strap 604 in a turret or other moveable fixture such that the light 606 may be directed independently of the orientation of the watch strap 604. Power may be supplied to the light 606 from the watch 602, or from a battery (not shown) within the watch strap 604. Other useful locations for a light may include, for example, within a button on the face of the watch (such as a sports watch) with the light activated by depressing the button, on the tip of the crown of the watch with the light activated when the crown is pulled out from the watch, or within the buckle or clasp of the watch strap. All such locations are intended to fall within the scope of this description.

While the invention has been disclosed in connection with the preferred embodiments shown and described in detail, it will be understood that the invention is not to be limited to the embodiments disclosed herein, but is to be understood from the following claims, which are to be interpreted as broadly as allowed under the law.

What is claimed is:

1. An apparatus comprised of:

a watch;

a bezel rotatably coupled to the watch;

a power supply; and a light affixed to the bezel and electrically coupled to the power supply.

2. The apparatus in claim 1 wherein the light emits light with peak luminous intensity directed away from a face of the watch.

3. The apparatus in claim 1 further comprised of time-delay circuitry that de-energizes the light after a fixed period of time following the energization of the light.

4. The apparatus in claim 1 further comprised of a button for at least one of activating or deactivating the light.

5. The apparatus in claim 1 further comprised of:

at least one ring of electrically conductive material disposed on the watch casing; and at least one contact pad disposed on the bezel, the contact pad electrically connected to at least one of the power supply or the light, and the contact pad positioned to maintain continuous electrical contact with the ring.

6. The apparatus in claim 1 further comprised of:

two rings of electrically conductive material disposed on the watch casing and electrically connected to the power supply; and two contact pads disposed on the bezel, the contact pads electrically connected to the light, and the contact pads positioned to maintain continuous electrical contact with the rings.

7. The apparatus in claim 1 further comprised of:

at least one ring of electrically conductive material disposed on the bezel; and at least one contact pad disposed on the watch casing, the contact pad electrically connected to at least one of the power supply or the light, and the contact pad positioned to maintain continuous electrical contact with the ring.

8. The apparatus in claim 1 further comprised of:

two rings of electrically conductive material disposed on the bezel and electrically connected to the light; and two contact pads disposed on the watch casing, the contact pads electrically connected to the power supply, and the contact pads positioned to maintain continuous electrical contact with the rings.

9. An apparatus comprised of:

a watch;

an illumination means for providing illumination;

a rotating means for rotatably coupling the light to the watch;

a time-delay means for deactivating the illumination means after a fixed period of time following an activation of the illumination means; and a power supply means for supplying power to the illumination means.

10. The apparatus in claim 9 further comprised of control means for control at least one of activation or deactivation of the illumination means.

11. An apparatus comprised of:

a watch;

a light in a button on a perimeter of the watch, the light emitting illumination with a peak luminous intensity directed away from a face of the watch, the light alternately energized and de-energized by pressing the button; and a power supply that provides power to the light when the light is energized.

12. The apparatus of claim 11 wherein the light is movably coupled to a case of the watch, whereby the peak luminous intensity of the light is steerable, such that the peak luminous intensity is directed independently of an orientation of the watch.

13. The apparatus in claim 11 further comprised of circuitry that deactivates the light after a fixed period of time following activation of the light.

14. An apparatus comprised of:

a watch having a face and a button on the face;

a light in the button on the face of the watch, the light emitting illumination with a peak luminous intensity directed away from the face of the watch, the light alternately energized and de-energized by pressing the button; and a power supply that provides power to the light when the light is energized.

15. An apparatus comprised of:

a watch strap for securing a watch about a wrist of a user;

a light on the watch strap, the light emitting illumination with a peak luminous intensity directed away from the watch strap, said light alternately energized and de-energized by pressing a button, the light being moveably attached to the watch strap; and a power supply that provides power to the light when the light is energized.

16. The apparatus of claim 15 wherein the power supply is a battery within the watch.

17. An apparatus comprised of:

a watch;

a crown rotatably coupled to the watch;

a power supply; and a light affixed to the crown and electrically coupled to the power supply.

18. The apparatus of claim 17 further comprising a button for controlling activation and deactivation of the light.

19. The apparatus of claim 17 further comprising circuitry that deactivates the light after a fixed period of time following activation of the light.

* * * * *